US008056721B2

(12) United States Patent
Hession

(10) Patent No.: US 8,056,721 B2
(45) Date of Patent: Nov. 15, 2011

(54) PACKAGE ASSEMBLY OF DISPLAY CARDS

(75) Inventor: Christopher Hession, Mechanicsville, VA (US)

(73) Assignee: MeadWestvaco Corporation, Richmond, VA (US)

( * ) Notice: Subject to any disclaimer, the term of this patent is extended or adjusted under 35 U.S.C. 154(b) by 332 days.

(21) Appl. No.: 11/989,657

(22) PCT Filed: Jul. 28, 2006

(86) PCT No.: PCT/US2006/029354

§ 371 (c)(1),
(2), (4) Date: Aug. 6, 2009

(87) PCT Pub. No.: WO2007/016322

PCT Pub. Date: Feb. 8, 2007

(65) Prior Publication Data

US 2010/0018894 A1 Jan. 28, 2010

Related U.S. Application Data

(60) Provisional application No. 60/704,229, filed on Jul. 29, 2005.

(51) Int. Cl.
*B65D 73/00* (2006.01)
*B65D 5/50* (2006.01)
*G09F 1/00* (2006.01)

(52) U.S. Cl. ..... 206/461; 206/45.24; 206/756; 40/124.06

(58) Field of Classification Search ..... 206/45.24, 206/461–465, 467–471, 764–765, 756; 40/124.01, 40/124.06

See application file for complete search history.

(56) References Cited

U.S. PATENT DOCUMENTS

| | | | | | |
|---|---|---|---|---|---|
| 2,078,018 | A | | 4/1937 | Powell | |
| 3,313,407 | A | | 4/1967 | Palm, Jr. | |
| 3,587,848 | A | * | 6/1971 | Froehlig | 206/462 |
| 3,912,079 | A | | 10/1975 | Selchow, Jr. | |
| 3,927,761 | A | | 12/1975 | Boyle | |
| 4,014,134 | A | * | 3/1977 | Womack, Jr. | 206/461 |
| 4,025,039 | A | | 5/1977 | Croll et al. | |
| 4,133,429 | A | * | 1/1979 | Kuchenbecker | 206/465 |
| 4,171,050 | A | * | 10/1979 | Murray et al. | 206/463 |
| 4,485,922 | A | | 12/1984 | Desmond et al. | |
| 4,531,637 | A | * | 7/1985 | Cusmano | 206/461 |
| 4,877,137 | A | * | 10/1989 | Govang et al. | 206/597 |

(Continued)

FOREIGN PATENT DOCUMENTS

GB 2 096 574 A 11/1981

*Primary Examiner* — Bryon Gehman
(74) *Attorney, Agent, or Firm* — MWV IP Group

(57) ABSTRACT

The invention provides a package assembly(100) including a base including a bottom portion (112) and a plurality of vertically oriented display cards (130)arranged on the base. Each display card includes a top edge (138), a bottom edge (140),a display portion (134) and a first support portion (136) attached to the display portion along a vertical fold (150). The display portion of each card is preferably disposed in a different plane and at a first angle with respect to the first support portion, wherein the bottom edge ofeach card is disposed on the base. The display cards are configured and adapted to withstand a vertical load applied to the package assembly. In accordance with another aspect, the invention can further include a shipping cover (160)disposed over the display cards, the shipping cover configured and adapted to protect the display cards during shipment.

19 Claims, 4 Drawing Sheets

U.S. PATENT DOCUMENTS 5,372,299 A 12/1994 Edgerton, Jr. et al.
5,435,085 A * 7/1995 Johnson ..... 40/124.06
5,573,117 A 11/1996 Adams
5,979,662 A * 11/1999 Green ..... 206/764
6,050,420 A 4/2000 Green
6,135,289 A 10/2000 Miller
6,152,305 A 11/2000 Green
6,367,632 B1 4/2002 Green
6,386,371 B1 5/2002 Parsons
6,427,842 B1 8/2002 Green
6,431,363 B1 8/2002 Hacker
2004/0195148 A1 10/2004 Seno et al.

* cited by examiner

PACKAGE ASSEMBLY OF DISPLAY CARDS

CROSS REFERENCE TO RELATED APPLICATIONS

This application claims priority to U.S. Provisional Patent Application Ser. No. 60/704,229, filed Jul. 29, 2005, the disclosure of which is herein incorporated by reference in its entirety.

BACKGROUND OF THE INVENTION

1. Field of the Invention

The present invention relates to a packaging assembly for housing products for sale, and more particularly to, a packaging assembly that is configured and adapted to provide a convenient, sturdy and cost efficient way to ship and display a plurality of products.

2. Background of the Related Art

A variety of devices are known in the art for shipping and displaying packages. Recently, efficient and cost-effective packaging techniques have been developed for displaying and preventing theft of small and expensive products, particularly in large retail outlets. Typically, the package has a large stiff configuration with an inner pocket that holds the product the customer desires. Since the package is large, it is much more difficult or awkward for a shoplifter to conceal than the product by itself. The package is also tamper resistant and cannot be torn or opened manually, thus further discouraging theft.

Such product packaging is provided in various forms. In one form two large sheets of stiff but strong plastic are sealed at their edges, with the product sealed in an interior pocket formed by the sheets. In another form, a single sheet of stiff plastic is sealed at its periphery to a similar sized, large stiff card, with the product pocket formed in the plastic. In a third form, a plastic product compartment is sealed to a single large stiff card. These packages are referred to by various names, such as blister packs or clam shells.

Moreover, the prior practice involving the use of plastic clamshell packaging can be advantageous since such packaging is both capable of encapsulating and displaying a product as well as supporting a top load. Such systems are described, for example, in U.S. Pat. Nos. 6,427,842; 5,372,299; and 5,573,117, each of which is incorporated by reference herein in its entirety.

However, typical plastic clamshell packaging is made from polyvinyl chloride ("PVC"), which is not generally recycled and releases harmful gaseous vapors when incinerated. Moreover, typical product display cards, such as those described, for example, in U.S. Pat. No. 3,313,407 are not configured to support a significant vertical load, requiring extra packaging to prevent the products from being crushed during shipment and/or display.

Thus, there still remains a continued need in the art for simple packaging assembly and method that is easy to manufacture and provides a cost efficient way to ship and display a plurality of products.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied herein and broadly described, the invention includes a package assembly. The package assembly includes a base including a bottom portion and a plurality of vertically oriented display cards arranged on the base. Each display card includes a top edge, a bottom edge, a display portion and a first support portion attached to the display portion along a vertical fold. The display portion of each card is preferably disposed in a different plane and at a first angle with respect to the first support portion, wherein the bottom edge of each card is disposed on the base. The display cards are configured and adapted to withstand a vertical load applied to the package assembly.

In another aspect of the invention, the base can include a plurality of side portions wherein each display card is received by at least one of the side portions. Each display card is preferably received in a slot in at least one of the side portions. It is also possible to affix each display card to at least one of the side portions.

In accordance with a further aspect of the invention, each display card can further include a second support portion attached to the display portion along a second vertical fold, the display portion of each card being disposed in a different plane and at a second angle with respect to the second support portion. The first angle and second angle can each be ninety degrees, among others such as acute angles. The base preferably includes two vertical side walls and a front wall and a back wall, and wherein the display cards are arranged in the base such that each support portion of each card is in abutting contact with a side wall, and the display cards are arranged in mutually supporting contact with one another. Moreover, if the base includes first and second vertical side portions, each side portion can define a plurality of slots adapted and configured to receive one of the display cards.

In accordance with another aspect, the invention can further include a shipping cover disposed over the display cards, the shipping cover configured and adapted to protect the display cards during shipment. The shipping cover preferably includes a top portion and a plurality of downwardly extending wall portions, wherein the wall portions are in abutting contact with the base.

In accordance with another embodiment of the invention, a product display system is provided including a package assembly as described above, and a product disposed on the display portion of at least one of the display cards.

The present disclosure is also directed to a package assembly for shipping, storing and displaying products. The package assembly includes a shipping box and a plurality of vertically oriented display cards disposed within the shipping box. The shipping box has base portion and a removable cover portion, which in combination define top, bottom and side walls for the shipping box and an interior product storage compartment.

The plurality of vertically oriented display cards are adapted for being placed within the interior product storage compartment of the shipping box. Each card has a top edge, a bottom edge, a display portion and a first support portion attached to the display portion along a vertical fold. The display portion of each card is disposed in a different plane and at a first angle with respect to the first support portion, wherein the bottom edge of each card is disposed on the base portion and the display cards are configured and adapted to withstand a vertical load applied to the package assembly.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF THE DRAWINGS

So that those having ordinary skill in the art will better understand how to make and use the packaging assembly of the subject invention, embodiments thereof will be described below with reference to the drawings wherein.

DETAILED DESCRIPTION OF THE PREFERRED EMBODIMENT

Reference will now be made in detail to the present preferred embodiments of the invention, an example of which is illustrated in the accompanying drawings. The method and corresponding steps of the invention will be described in conjunction with the detailed description of the system.

The devices and methods presented herein can be used to provide a convenient and cost effective way to ship and display a plurality of products. The advantages of packaging assemblies made in accordance with the invention include the ability of the packaging assembly to accommodate a wide range of products and still support a top load, which is highly desirable in retail and club store applications. The embodiments disclosed herein can be made using a foldable material to which a product to be sold can be adhered or captured and displayed.

Packaging assemblies made in accordance with the invention also provides advantages in cost and material reduction as well as the environmental impact of the materials used. Typical plastic clamshells use PVC, which is not typically recycled and releases harmful gaseous vapors when incinerated. Using a packaging assembly made of corrugated or other paper board is not only more environmentally friendly but also potentially less expensive. The tooling and manufacture for the product display card is not specialized.

In accordance with the invention, a packaging assembly is provided including a base including a bottom portion and a plurality of vertically oriented display cards arranged on the base.

Figure 1:
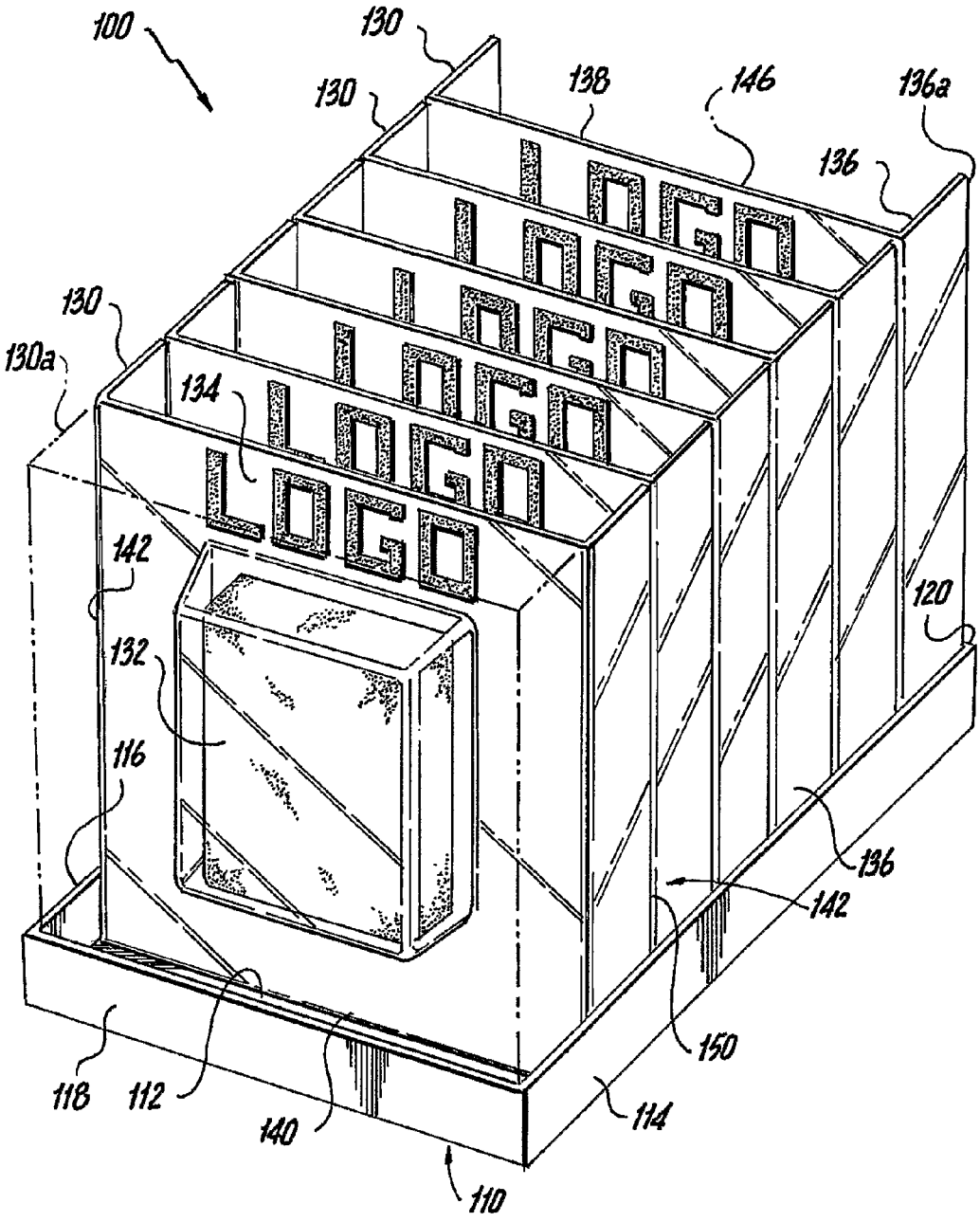
FIG. 1 is an isometric view of a first representative embodiment of a packaging assembly in accordance with the present invention.

For purpose of explanation and illustration, and not limitation, a view of an exemplary embodiment of the packaging assembly in accordance with the invention is shown in FIG. 1 and is designated generally by reference character 100. Other embodiments of a packaging system in accordance with the invention, or aspects thereof, are provided in FIGS. 2-5, as will be described.

As depicted, packaging assembly 100 includes a base 110 having a bottom portion 112, and optionally a plurality of upwardly extending vertical portions, such as sides 114 and 116, as well as a front 118 and a back 120. In practice, base 110 would preferably be constructed from at least one blank of foldable material, such as corrugated card board. Moreover, it is possible to form sides 114, 116 into additional shapes such as a rectangular or triangular member or folded and glued to create an I-beam.

Packaging assembly 100 also includes a plurality of display cards 130 for supporting a product 132. Display cards 130 include at least one display portion 134, and at least one support portion 136 attached to the display portion 134 along a vertical fold 150. Each display card 130 includes a top edge 138, a bottom edge 140, side edges 142. The display portion 134 of each display card 130 is preferably disposed in a different plane and at a first angle with respect to the support portion 136, wherein the bottom edge 140 of each display card 130 is disposed on the base 110.

Figure 2:
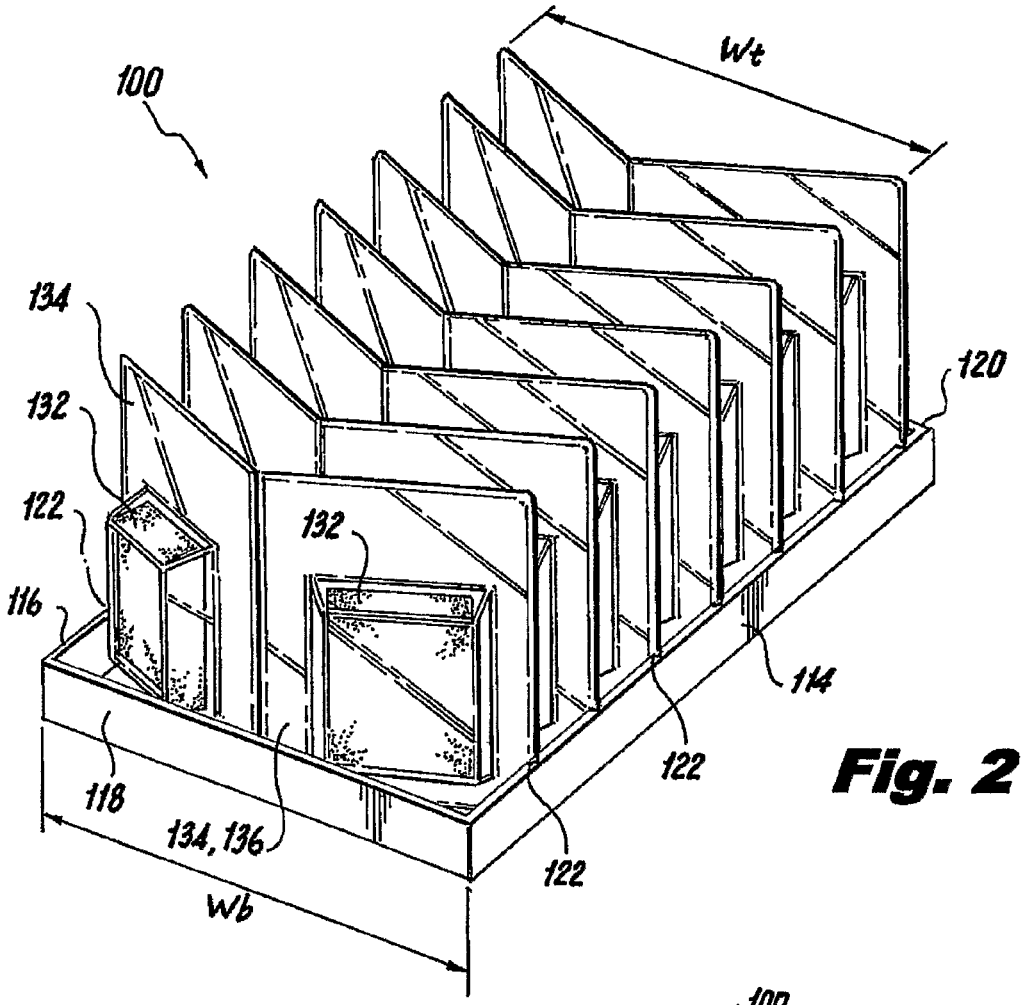
FIG. 2 is an isometric view of a second representative embodiment of a packaging assembly in accordance with the present invention.
Figure 3:
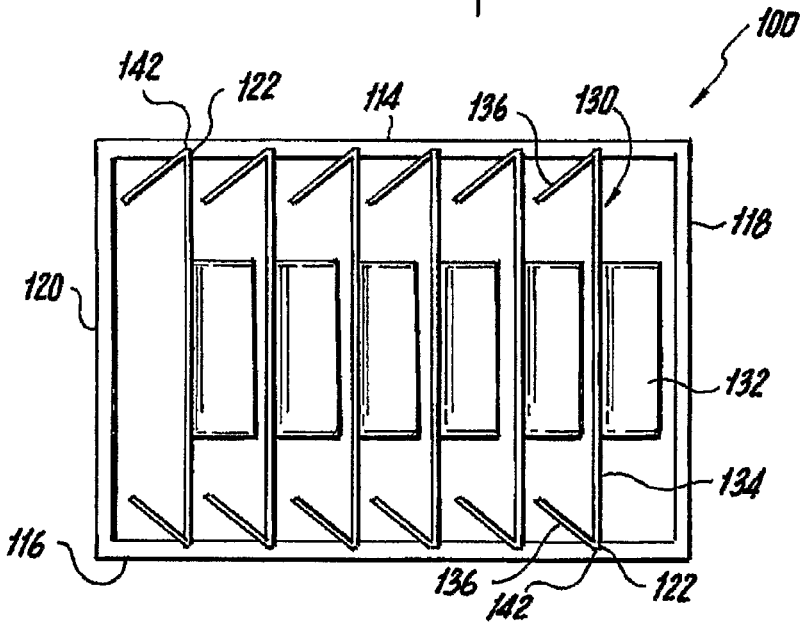
FIG. 3 is an top schematic view of a third representative embodiment of a packaging assembly in accordance with the present invention.

While a display card 130 can be provided with two support portions 136 as depicted in FIG. 1, it is also possible to provide a display card 130 having a product display portion 134 and a single support portion 136 as depicted in FIG. 2. As depicted in FIG. 2, it is possible for support portion 136 to also act as a product display portion 132.

Base 110 is also preferably designed such that the interior width Wb is approximately equal to display card 130 width Wt with the support portions 136 folded. The base 110 is also preferably sized front to back according to the number of products being displayed and the orientation of the folded support panels.

The display cards 130 are configured and adapted to withstand a vertical load applied to the package assembly 100. This ability to withstand vertical loads arises from the fact that each display card 130 is folded, as described above. Folding each display card effectively increases its section modulus, greatly enhancing the ability of each display card 130 to withstand bending and buckling arising from vertical loading. As described herein, display card 130 can be folded in a variety of ways, such as by pre-forming perforations along vertical fold 150. Alternatively, display cards 130 can be formed by machine folding, or by forming them with a "C" shaped cross-section, such as by extrusion.

Figure 4:
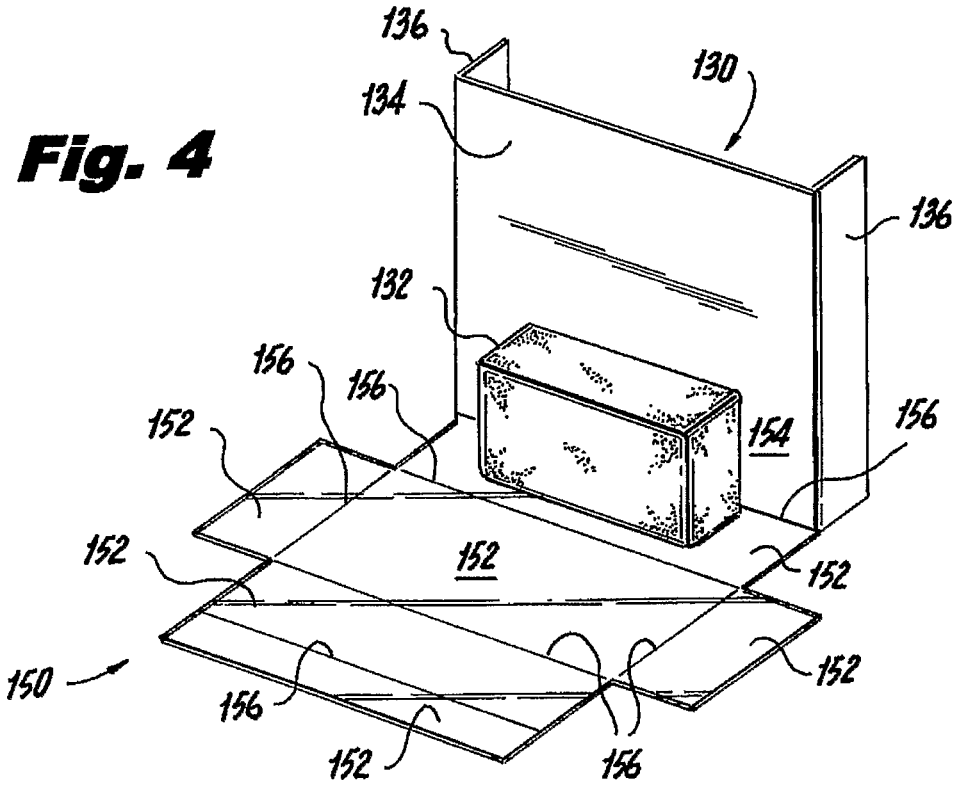
FIG. 4 is an isometric view of an alternative embodiment of a portion of a packaging assembly in accordance with the present invention.

Preferably, display portion 134 of each display card 130 is disposed in a different plane and at an angle with respect to the support portions 136. Support portions 136 can be at a 90 degree angle with respect to display portion 134, although other angles are possible. For example, acute angles can be used. For example, as depicted in FIG. 4, each edge 142 of each folded display card 130 is received by one of a plurality of slots 122 in sides 114, 116 of base 110.

Preferably, the base 110 includes walls on all four sides 114, 116, 118, 120. This can be advantageous if display portion 134 and support portions 136 are at right angles. In accordance with this embodiment, as depicted in FIG. 1, the display cards 130 are arranged in the base 110 such that the edges 136*a* of support portions 136 are in an abutting relationship with edges 142 of an adjacent display card, such that the display cards are in mutually supporting contact with one another. The embodiment of FIG. 1 shows empty space in base 110 not occupied by a display card 130 proximate the back wall 120 of base for illustration purposes only. Display cards 130 are preferably tightly packed within base 110 to pack display cards 130 close together, resulting in enhanced support. Moreover, a blank display card 130*a* can be supplied proximate front wall 118 of base 110 (shown in dashed lines in FIG. 1) to provide support for display cards 130.

Packaging assembly 100 can be made from a variety of materials. Most preferably, packaging assembly 100 is formed from paper based materials, including cardboard, fiber board and other materials, such as corrugated plastics, among other things. For example, mixed substrates can be used if more than one layer of material is desired where various layers could have tear resistant properties. There are no doubt many other suitable methods of combining a product to a card that can be incorporated into this system.

The display card 130 can be made from at least one foldable blank of material with folds specifically designed to create a beam-like structure capable of supporting a top load. Display card 130 preferably includes a rectangular display panel 134 with two side support panels 136 attached at each side 142 of the display panel 134 by a foldable score. When these side panels are folded in either the forward or backward direction at between 0 and 180 degrees the display card 130 becomes capable of supporting a top load.

Product 132 can include any product that can be affixed to a product display card 130 and include, for example, computer components and peripherals, such as memory devices, among other things. Product 132 can be affixed to display card 130 by any means known to the art, such as by way of adhesives or mechanical connection such as tab and groove or other mechanical fasteners such as staples or rivets. As used herein, the term affixed is intended to broadly include all practicable manners of holding product 132 in a desired location with respect to display card 130. For example, as depicted in FIG. 4, it is possible to secure a blister 151 or a self contained carton to the face of the card using any number of adhesives known. For example, non-detachable adhesives such as hot melt adhesive can be used. Additionally or alternatively, fugitive adhesives permitting detachment can also be used. Moreover, display cards 130 can be held in base 110 by use of a fugitive adhesive as well, which can eliminate the need for one or more portions 114, 116, 118 and 120. Moreover, it is possible to provide a product display card 130 including panels 152 configured and adapted to fold about score lines 156 around a product 132. Panels 152 are joined to a base panel 154, as disclosed in FIG. 4.

Figure 5:
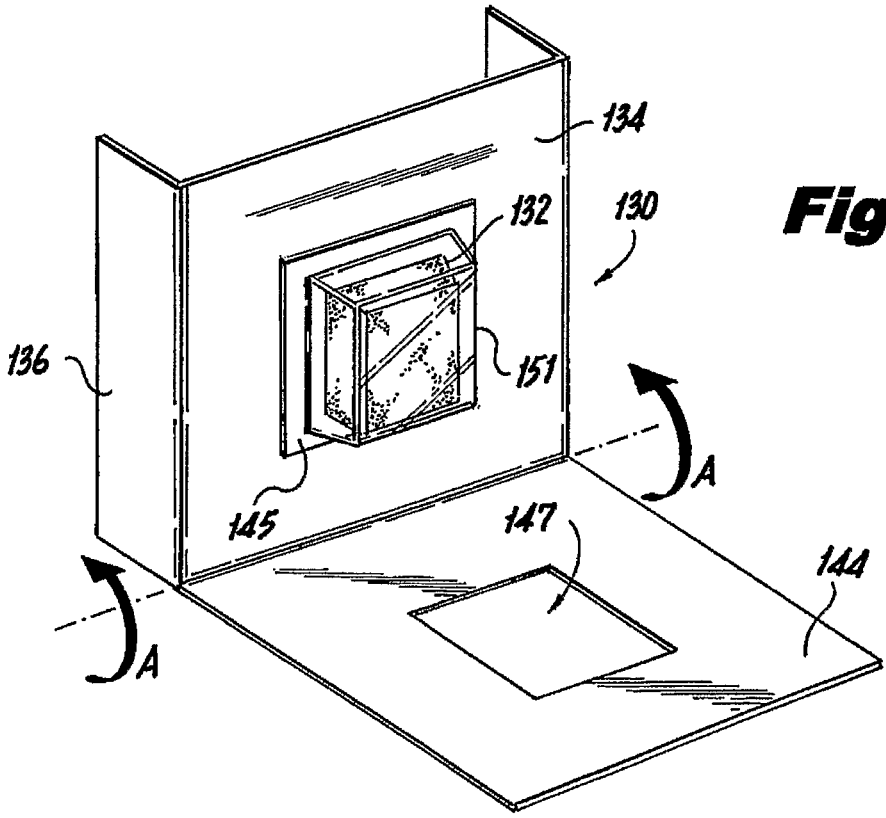
FIG. 5 is an isometric view of another alternative embodiment of a portion of a packaging assembly in accordance with the present invention.

By way of further example, as depicted in FIG. 5, it is also possible to provide a product display card that farther includes a face seal portion 144 that can be disposed over display portion 134 to trap product 132 inside of display card 130 when face seal portion 144 and display portion 134 are brought together into intimate contact. Face seal portion 144 defines an aperture 147 that is sized and shaped to pass over product 132, but to be smaller than flange portion 145 attached to packaging material containing product 132. When portions 134 and 144 are then fastened together, product 132 is trapped inside display card 130 mechanically, even though product 130 need not be attached to display card by way of adhesive.

Portions 134 and 144 can be held together, for example by adhesive or other mechanical means, such as a tabbed or folded connection and/or by means of a fastener such as a staple or rivet. Face seal portion 144 can be formed from the same blank of material as display card 130 and be folded over as depicted in FIG. 5, or can be provided as a separate member. Portions 134, 144 can also be provided with an adhesive, such as a hot melt adhesive, sprayed or otherwise pre-applied to the material that portions 134, 144 are made from. In this manner, after being folded together to capture a product 132, heat and pressure can be applied to portions 134, 144 to activate the hot melt adhesive, and thus form a very strong bond to form display card 130.

Figure 6:
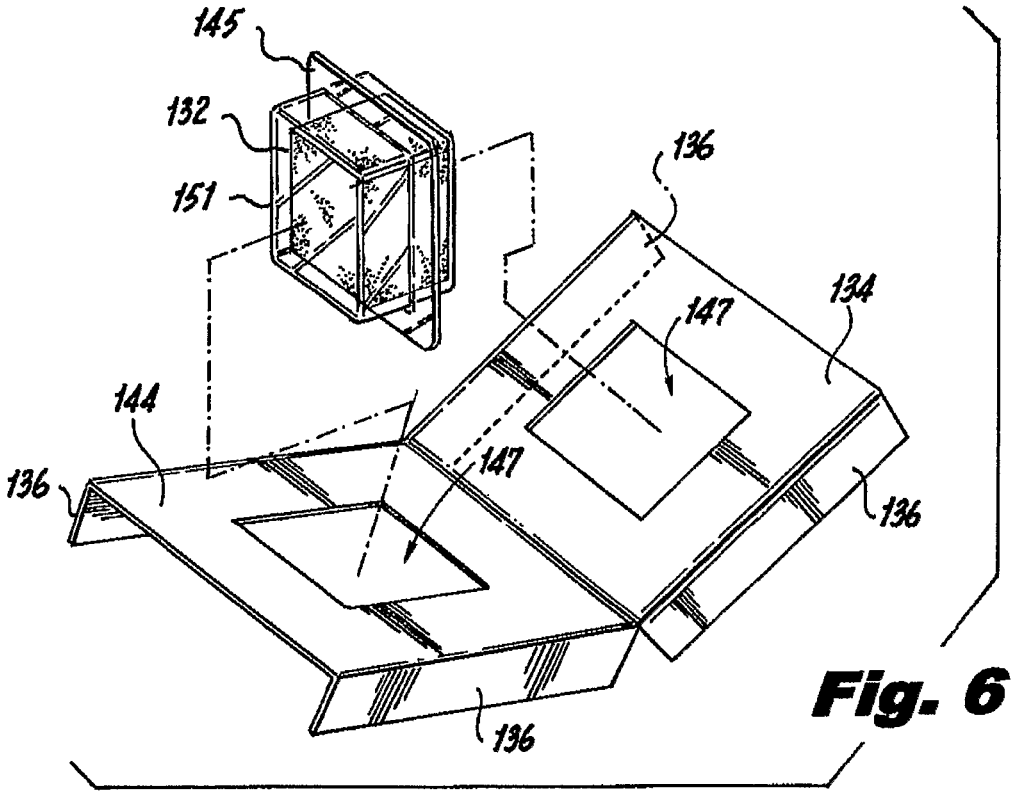
FIG. 6 is an isometric view of yet another alternative embodiment of a portion of a packaging assembly in accordance with the present invention.

By way of further example, as depicted in FIG. 6, display card 130 can be made of mirror image halves of material, each half including an aperture 147 to trap a product 132 in a blister pack 151 having a flange 145. This results in a highly efficient use of space, since product 132 can occupy the entire depth of support members 136. Thus, a more compact shipping assembly is provided when a plurality of display cards 130 containing products 132 in this manner are packed into a base portion 110. Moreover, this also results in a display card with an "I" beam type of cross section, lending even greater strength and stability to packaging assembly 100. Thus, it is possible to display a product 132 through the middle of display card 130. Moreover, it is possible to provide a product on the back 146 of display card. For example, a product 132 could be attached to the back 146 of display card 130 in the embodiment of FIG. 1 as well as the front. Product 132 can be positioned in the geometric center of the back 146, or offset toward the top, bottom, sides or corner, as desired, to avoid interference with adjacent products.

In accordance with a further aspect of the invention, a shipping cover can be provided to further protect products being shipped.

Figure 7:
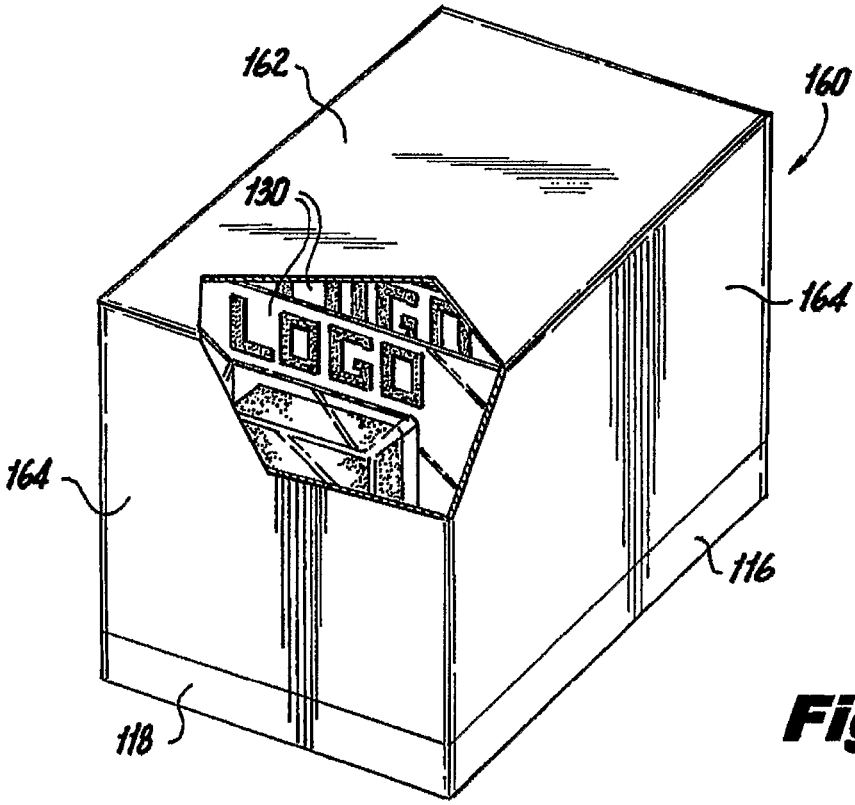
FIG. 7 is an isometric view of still another alternate embodiment of a packaging assembly in accordance with the present invention.

For purposes of illustration, and not limitation, as embodied in FIG. 7 a shipping cover 160 is disposed over the display cards 130. The shipping cover 160 is configured and adapted to protect the display cards 130 during shipment. The shipping cover 160 preferably includes a top portion 162 and a plurality of downwardly extending wall portions 164. Preferably, the wall portions 164 are in abutting contact with the base 110. if provided, wall portions 114, 116, 118, 120, of base 110 can be configured to abut wall portions 164 as depicted in FIG. 7. Alternatively, wall portions 164 can be adapted to be received inside or outside of base 110. When installed over base 110 and display cards 130, shipping cover 160 can then be taped along its open edges to the under side of base 110 for storage and shipment.

After being received at a retail location, packaging assemblies 100 can be stacked. Vertical support is provided in significant part by product display cards 130. The shipping cover 160 can be removed from the uppermost box to provide for a display of products 132. Thus, a product display system is provided including a package assembly 100 as described above, and a product 132 disposed on the display portion 134 of at least one of the display cards 132.

The invention also includes a method of making a packaging assembly as provided herein. The methods and systems of the present invention, as described above and shown in the drawings, provide for a packaging assembly with superior properties including enhanced rigidity, yet reduced cost and environmental impact, and potentially cost. It will be apparent to those skilled in the art that various modifications and variations can be made in the device and method of the present invention without departing from the spirit or scope of the invention. Thus, it is intended that the present invention include modifications and variations that are within the scope of the appended claims and their equivalents.

What is claimed is:

1. A package assembly comprising:

a) a base including a bottom portion; and b) a plurality of vertically oriented display cards arranged on the base, each card made of paper based material and having:

i) a top edge;

ii) a bottom edge;

iii) a display portion having a first side edge and a second side edge opposite the first side edge; and iv) a first support portion attached to the display portion along a vertical fold forming the first side edge, the display portion of the card being disposed in a different plane and at a first angle with respect to the first support portion, wherein the bottom edge of the card is disposed on the base;

v) a second support portion attached to the display portion along a second vertical fold forming the second side edge, the display portion of the card being disposed in a different plane and at a second angle with respect to the second support portion;

wherein the heights in the vertical direction of the first and second support portions, the vertical folds, and the display portion are equal; and wherein the display portion, the first support portion, and the second support portion are each in different vertical planes.

2. The package assembly of claim 1, wherein the base includes first and second vertical side portions; each display card being received by at least one of the side portions.

3. The package assembly of claim 2, wherein each display card is received in a slot in at least one of the side portions.

4. The package assembly of claim 2, wherein each display card is affixed to at least one of the side portions.

5. The package assembly of claim 1, wherein the first angle and second angle are each ninety degrees.

6. The package assembly of claim 1, wherein the first angle and second angle are each acute angles.

7. The package assembly of claim 6, wherein the base includes first and second vertical side portions, each side portion defining a plurality of slots adapted and configured to receive one of the display cards.

8. The package assembly of claim 1, wherein the base includes two vertical side walls and a front wall and a back wall, and wherein the display cards are arranged in the base such that each support portion of each card is in abutting contact with at least one of said vertical side walls, and the display cards are arranged in mutually supporting contact with one another.

9. The package assembly of claim 1, further comprising a shipping cover disposed over the display cards, the shipping cover configured and adapted to protect the display cards during shipment.

10. The package assembly of claim 9, wherein the shipping cover includes a top portion and a plurality of downwardly extending wall portions, wherein the wall portions are in abutting contact with the base.

11. A product display system comprising:

a) the package assembly of claim 1; and b) a product disposed on the display portion of at least one of the display cards.

12. The product display system of claim 11, wherein the first angle and second angle are each ninety degrees.

13. The product display system of claim 12, wherein the base includes two vertical side walls and a front wall and a back wall, and wherein the display cards are arranged in the base such that each support portion of each card is in abutting contact with at least one of said vertical side walls, and the display cards are arranged in mutually supporting contact with one another.

14. A package assembly for shipping, storing and displaying products comprising:

a) a shipping box having a base portion and a removable cover portion, the base portion and cover portion in combination define top, bottom and side walls for the shipping box and an interior product storage compartment;

b) a plurality of vertically oriented display cards disposed within the interior product storage compartment of the shipping box, each card made of paper based material and having a top edge, a bottom edge, a display portion having a first side edge and a first support portion attached to the display portion along a vertical fold forming the first side edge, the display portion of each card being disposed in a different plane and at a first angle away from the first support portion, the display portion further having a second side edge and a second support portion attached to the display portion along a second vertical fold forming the second side edge, the display portion of each card being disposed in a different plane and at a second angle away from the second support portion, wherein the bottom edge of each card is disposed on the base portion and wherein the height of the first and second support portions in the direction of the vertical fold is equal to the height of the display portion in the direction of the vertical fold.

15. The package assembly of claim 14, wherein the base portion includes first and second vertical side portions; each display card being received by at least one of the side portions.

16. The package assembly of claim 15, wherein each display card is received in a slot in at least one of the side portions.

17. The package assembly of claim 14, wherein the first angle and second angle are each acute angles.

18. The package assembly of claim 17, wherein the base portion includes first and second vertical side portions, each side portion defining a plurality of slots adapted and configured to receive one of the display cards.

19. A package assembly comprising:

a) a base including a bottom portion; and b) a plurality of vertically oriented display cards arranged on the base, each card made of paper based material and having:

i) a top edge;

ii) a bottom edge;

iii) a display portion having a first side edge and a second side edge; and iv) a first support portion attached to the display portion along a first vertical fold forming the first side edge, the display portion being disposed in a different plane and at a first angle away from the first support portion, v) a second support portion attached to the display portion along a second vertical fold forming the second side edge, the display portion being disposed in a different plane and at a second angle away from the second support portion, wherein the bottom edge of each card is disposed on the base;

wherein the height of the first support portion in the direction of the first vertical fold is equal to the height of the display portion in the direction of the first vertical fold, and wherein the height of the second support portion in the direction of the second vertical fold is equal to the height of the display portion in the direction of the second vertical fold.

* * * * *